US005762942A

United States Patent [19]

Rochester

[11] Patent Number: 5,762,942

[45] Date of Patent: Jun. 9, 1998

[54] PROCESS OF MECHANICAL PLATING

[76] Inventor: Thomas H. Rochester, 2350 Vandemere Rd., Jackson, Mich. 49201

[21] Appl. No.: 628,925

[22] Filed: Apr. 8, 1996

[51] Int. Cl.[6] ..... B05D 3/12; C23C 18/31

[52] U.S. Cl. ..... 427/242; 427/436; 106/1.05

[58] Field of Search ..... 427/11, 436, 242; 106/1.05

[56] References Cited

U.S. PATENT DOCUMENTS

| | | | |
|---|---|---|---|
| Re. 23,861 | 8/1954 | Clayton . | |
| 2,640,001 | 5/1953 | Clayton . | |
| 2,640,002 | 5/1953 | Clayton . | |
| 2,689,808 | 9/1954 | Clayton . | |
| 2,723,204 | 11/1955 | Pottberg et al. . | |
| 3,400,012 | 9/1968 | Golben . | |
| 3,443,985 | 5/1969 | Cutcliffe . | |
| 3,460,977 | 8/1969 | Golben . | |
| 3,531,315 | 9/1970 | Golben . | |
| 4,389,431 | 6/1983 | Erismann . | |
| 4,832,985 | 5/1989 | Clayton | 427/242 |
| 5,156,672 | 10/1992 | Bishop | 106/1.05 |

*Primary Examiner*—Janyce Bell
*Attorney, Agent, or Firm*—Young & Basile, P.C.

[57] ABSTRACT

A method for adding pulverulent metal to mechanical plating processes occurring within an agitating container in which the parts to be plated are tumbled with an impact media and a pulverulent coating metal. The pulverulent material is introduced into the parts' container in a thick slurry capable of maintaining the pulverulent metal in suspension. The introduction of the metal into the plating container by the slurry produces a more uniform dispersion of the metal within the container than previous metal introducing practices. The slurry, itself, may include additives other than thickeners to improve the coating process.

20 Claims, No Drawings

PROCESS OF MECHANICAL PLATING

BACKGROUND OF THE INVENTION

1. Field of the Invention

The invention pertains to mechanical metal plating and metal galvanizing processes and slurries for improving powdered metal dispersion within the plating container.

2. Description of the Related Art

Mechanical plating and galvanizing is used with parts which may be adversely affected by more conventional electroplating or dipping processes, and such plating is used to place a protective coating upon the metal part by impacting small particles of the covering metal upon the part to be plated. Impacting is commonly produced by the use of glass beads located within a tumbling container or barrel wherein the mechanical movement of the parts and glass beads in the container within a solution including various cleansing and treatment agents in addition to the pulverulent metal results in a thin layer of pulverulent material being applied to the surface of the parts in a substantially uniform thickness.

Early mechanical plating processes are shown in U.S. Pat. Nos. 2,640,001; 2,640,002; Re. 23,861; 2,689,908 and 2,723,204.

It is known, in mechanical plating processes, to apply a deposit of tin to a previously coppered substrate or part using a tin salt and a more active metal as a reducing agent to serve as a driving metal, as shown in U.S. Pat. No. 3,400,012. The use of glass beads as an impact media is disclosed in U.S. Pat. No. 3,443,985, and such impact media has proven effective and popular, and is widely employed today in mechanical plating processes. The use of a surfactant in a mechanical plating solution to improve deposits in the plating metal is shown in U.S. Pat. No. 3,460,977, and the use of strong acids in the mechanical plating and galvanizing processes is discussed in U.S. Pat. Nos. 3,531,315 and 4,389,431.

In conventional mechanical plating, and mechanical galvanizing processes, the parts to be coated are normally placed within a rotating container or drum containing water, cleansing acids, coppering and tinning additives, and, perhaps, a surfactant. Once the parts have been processed and tinned, and are ready for coating by the plating material, the pulverulent plating material in the form of powder is added to the agitating mixture. The powder may be thrown into the rotating container, but such haphazard and uncontrolled introduction of the powdered plating metal into the container often results in uneven plating thickness and a non-uniformity of plating specifications.

In the trade, it is known to mix the pulverulent powdered metal with water prior to introducing the metal into the drum, as shown in U.S. Pat. No. 4,514,093 but this "premixing" of the pulverulent metal has not proven completely satisfactory in view of the much higher density of the metal as compared with water wherein the metal will quickly fall to the bottom of the metal/water mixture and is not introduced into the mixing container in a uniform manner.

Until the advent of the instant invention, consistently uniform introduction of the pulverulent coating metal in a powdered form into a mechanical plating container had not been achievable.

OBJECTS OF THE INVENTION

It is an object of the invention to provide a superior manner of adding plating metal to an agitating container in which mechanical plating occurs.

Another object of the invention is to provide an effective means for adding plating material to the mechanical plating process which reduces plating variability and deviation with respect to plating thickness.

A further object of the invention is to provide a process for adding plating metal to the mechanical plating process wherein a smoother deposit of the metal on the parts being plated occurs than has been previously achievable.

An additional object of the invention is to provide a process for adding plating metal to a mechanical plating process which reduces occupational exposure to airborne metal powders, creating a healthier atmosphere and environment for workers.

Yet another object of the invention is to provide a process for adding plating metal to a mechanical plating operation wherein improved dispersement of the plating metal occurs where even thread forms may be properly covered with the coating metal powder and wherein zinc requirements are reduced while improving zinc utilization, thereby reducing the amount of zinc that must be pre-treated prior to discharge from the plater's waste treatment system.

Another object of the invention is to provide a process for adding plating metal to the mechanical plating process wherein the plating metal is contained within a pumpable slurry and is substantially uniformly dispersed therethrough, and wherein the plating metal maintains its suspension in the slurry for lengthy durations permitting stopping and starting of the slurry during metal introduction without significantly affecting the concentration of metal powder contained in the slurry by volume.

Yet another object of the invention is to provide a process for adding a coating metal powder to a mechanical plating process wherein the powder is contained in a thickened slurry and the thickener acts as a protective colloid which prevents charged particles in suspension from flocculating resulting in a smoother deposit of the metal upon the parts being coated.

SUMMARY OF THE INVENTION

An understanding of the invention is best appreciated when understanding the mechanical plating process. In a typical mechanical plating operation, clean parts free of oil and scale are loaded into a rubber or synthetic plastic lined plating barrel, usually hexagonal in shape, which is supported on bearings and is slowly rotatable about an axis of rotation. With the loading of the parts, or previously to such loading, impact media is loaded into the barrel. While the impact media may take a variety of forms, glass beads ranging from 4 mesh up to 100 mesh and of a spherical configuration are normally used. Equal quantities by volume of glass beads and parts are usually loaded in the barrel, and a sufficient amount of water is added to the barrel to accomplish plating and the water temperature may be adjusted as desired.

Usually thereupon, an inhibited acidic detergent cleaner is added to the barrel and the barrel rotated until the parts are free of oxide. A copper salt may then be added to the barrel which produces a tightly adherent immersion copper coating on the parts providing a base for subsequent mechanical plating.

Usually, the next step is to add a stannous tin salt or soluble divalent tin-engendering material to the barrel which is allowed to dissolve for a brief period. Then a small quantity of a "driving metal", powder, i.e. a reducing agent, is added and a thin deposit of tin is formed on the surface. Typically, with this addition, there are also added dispersants, inhibitors and surfactants.

Following the above, a plating metal in the form of a fine dust from 3 to 20 microns in size, usually zinc, tin or cadmium, is added to the plating barrel over a period of about fifteen minutes to one-half hour. This is the most critical of the plating steps and the operator must manually add metal powder to the liquid in the plating barrel, and such adding of the powder is usually done by sprinkling the plating metal over the liquid medium, trying to assure that the particles are as dispersed as possible before the first encounter with the parts or substrate being plated. During this phase of the operation, the small particles of plating metal are forced against the surface of the parts by the impact media producing a mechanical bonding of the coating metal with the parts' surface. After this plating phase is completed, the parts are separated from the media and dried. Often conventional chromates or other post-plate treatments are applied to the plated surface of the parts sometimes prior to drying.

It has been suggested that metal to be added to the mixture within the barrel be added to water and rapidly agitated, and then before the metal has settled, the metal/water mixture be added to the plating barrel. If practiced properly, this addition of the powdered metal to the plating barrel is somewhat effective for distributing the plating powder within the rotating barrel, but because the plating material is much denser than the water, the plating metal settles rapidly and it is difficult for small quantities of plating metal to be maintained universally dispersed through the water, and such uniform dispersion of large quantities of plating powdered metal is virtually impossible.

Mechanical plating is "mechanical" in the sense that the impact energy of the glass beads with the powdered coating metal is such that a "cold-welding" of metallic particles of the metal powder to the parts takes place. The chemicals provided to the environment only make the various surfaces amenable to such mechanical bonding.

In the practice of the invention, the introduction of the pulverulent coating metal to the rotating or agitating barrel is accomplished in a uniform and controlled manner because the coating metal is suspended in a thickened slurry of a viscosity great enough to prevent a rapid settling of the metal within the slurry, and the substantially uniform dispersion of the suspended pulverulent metal within the slurry permits the coating metal to be uniformly added to the mechanical plating barrel during the plating operation thereby controlling the coating process to a higher degree than heretofore possible. In the practice of the invention, a more uniform plating is achieved, difficult areas to plate, such as threads, can be greatly improved, a more uniform and better appearing plating surface is achieved, and the coating metal is most effectively utilized minimizing waste.

The primary ingredient of the thickened slurry is the plating metal itself, such as zinc, cadmium, tin, copper, aluminum, silver or any ductile pulverulent metal. The base carrier for the metal is water, which is also the fluid in which the mechanical plating process is conducted. The water carrier requires a thickener to prevent settling of the metal particles, which are usually five to ten times as dense as water, and preferably, the thickened solution has a mildly alkaline pH, and should be stable at low pH values in which the mechanical plating process is performed. A wide variety of thickeners for the slurry may be used, and such thickeners include natural gums, some of which are plant exudates, such as gum tragacanth, gum karaya, gum ghatti, gum arabic, xanthan gum and guar gum; modified natural products such as hydroxypropyl guar; synthetic water-soluble polymers such poly(ethylene oxide), polyethylene glycol, and polyacrylamide; cellulose derivatives such as sodium carboxymethylcellulose, carboxymethylhydroxyethylcellulose, hydroxypropylcellulose, hydroxyethylcellulose, hydroxypropylmethylcellulose, and methylcellulose; and inorganic thickeners such as bentonite clay and attapulgite clays and their derivatives; these thickeners and others not mentioned can be used alone or in combination with one another. These examples are meant to be illustrative rather than limiting the scope of the invention in any way.

Some who are skilled in the art of mechanical plating might eschew the addition of viscosity-increasing substances to the process in light of the fact that an increase in viscosity will cushion the mechanical impact, and, all other process characteristics being equal, will result in reduced efficiency. It is perhaps for this reason that prior to my current invention no one had added pulverulent metal to the barrel in a thickened slurry.

DESCRIPTION OF THE PREFERRED EMBODIMENTS

The basic concepts of the invention have been set forth above, and in the following paragraph, I discuss some of the aspects of mechanical plating which have been determined to be of advantage when using the inventive concepts, and examples are set forth in which the invention is practiced.

Preferably, the aqueous solution of the slurry incorporates a pH modifying agent. Zinc, which is the material most commonly plated during mechanical plating or mechanical galvanizing, is an amphoteric metal which dissolves in either alkaline or acidic media. Zinc is least reactive in a mild alkaline range, and it is preferred to use a mild alkali having a pH in the range of 8 to 10, or slightly above or below that range. Some of the alkalis that give pH's in that range are extremely dilute solutions of sodium or potassium hydroxide, magnesium hydroxide (pH of 10.5 in a saturated solution), sodium bicarbonate (8.4 in an 0.1N solution), calcium carbonate (pH of 9.4 a saturated solution) and borax (pH of 9.2 in a solution of 0.1N). Any alkali may be used in the practice of the invention as long as it holds the slurry at a pH high enough to prevent acidic attack on the pulverulent metal in the slurry and low enough to prevent caustic attack on the pulverulent metal in the slurry and does not interfere with any of the other chemicals in an adverse manner. Some alkalies, like lime, calcium carbonate, sodium silicate, and potassium silicate form precipitates in the sulfuric acid solution in which mechanical plating is most commonly performed; in addition, some alkalies are incompatible with some thickeners; for example, borax reacts with polyvinyl alcohol to form a firm gel.

It is preferable that the slurry of this invention incorporate a dispersant which will keep the particles separate. This helps to improve the quality of the coating process. Dispersants which are suitable for use in this invention include primarily, but are not limited to, condensed naphthalene sulfonates such as Daxad 11, Darvan No. 1, Tamol SN and the like, high molecular weight poly(ethylene oxide), high molecular weight poly(ethylene glycol), and surfactants with long chains of polyoxyethylene; such compounds include surfactants derived from nonylphenol, octylphenol, alcohols in the C-10 to C-20 range, particularly about C-12, generally ethoxylated with at least 20 moles of ethylene oxide and preferably more.

It is also preferable, though not necessary, that the slurry as used in the practice of the invention incorporate a defoamer in trace quantities. If such a defoaming compound is used, a silicone-based defoamer is preferred; if such a defoamer is used, defoaming agents which are effective in this invention include, but are not limited to, neat silicone defoamers, such as Wacker Silicones SWS 202 or SWS 203 or Dow Corning Antifoam A; if an emulsion is used, a product such as Dow Corning Antifoam Emulsion DC-1410, General Electric AF-75, Union Carbide SAG 10, or Harcros Silicone AF-10 can be used. All of these emulsions are 10% active. The active ingredient of all of these products is primarily polydimethylsiloxane. Preferably a silicone-based defoamer is desirable because it is highly effective at low dosage levels and only a few parts per million of active defoamer are required to adequately defoam the slurry of the invention.

It is also preferable that the slurry of the invention incorporate a surfactant, which will aid and assist in the wetting of the metal powder when it is first mixed with the water and other components of the slurry of the invention. Many surfactants can be utilized in the practice of this invention, such as lower-foaming ethoxylated alcohols or non-foaming surfactants such as 2-ethyl hexyl sulfate.

Below are set forth four examples of processes of mechanical plating or mechanical galvanizing utilizing the inventive concepts of the invention, and from these examples, the best mode for practicing the invention will be appreciated.

EXAMPLE 1

A small plastic plating barrel was charged with 2000 cc of glass impact media of which 50% was 5 mm in diameter, 25% was 10 to 13 mesh, 12½% was 16 to 25 mesh, and 12½% was 50 mesh. To this barrel was charged 1000 grams of self-drilling No. 10 screws 2" long and a sufficient quantity of water to form a puddle approximately halfway across the barrel. To this barrel was added 9 ml of an inhibited acidic detergent sold under the trade number 0170 by McGean-Rohco, which is approximately 50% sulfuric acid. The barrel was rotated at 30 rpm for about 5 minutes, after which the parts were clean. To this solution was then added, without rinsing, 1 gram of Copper Sulfate Pentahydrate and 1 gram of Sodium Chloride. After 3 minutes the parts had a bright copper appearance. Then the parts were rinsed several times and to the barrel was then added 1.4 grams of citric acid, 0.6 grams of diammonium citrate, 0.2 grams of Carbowax 20M (a high molecular weight polyethylene glycol from Union Carbide, Danbury Conn.), and 0.2 grams of Stannous Sulfate. After one minute there was added to the barrel 1 gram of zinc dust (grade MP-515 from Purity Zinc, Burlington, Ontario Canada) and after another two minutes the parts had the silvery appearance of tin. To the still-rotating barrel was then added, over a period of 15 minutes, a slurry suspension consisting of:

- 15 ml water
- 21 grams of zinc dust (MP-515)
- 0.04 grams Xanthan Gum (Aldrich Chemical, Milwaukee, Wisc.)
- 0.06 grams Attagel 50 (Engelhard Industries, Iselin, N.J.)
- 0.01 grams Darvan No. 1 (R. T. Vanderbilt, Norwalk, Conn.)
- A trace of SWS-202 Defoamer (Wacker Silicones, Adrian, Mich.) and a trace of Pluronic F68 (BASF, Mt. Olive, N.J.)
- 0.01 grams Magnesium Hydroxide (Aldrich Chemical, Milwaukee, Wisc.)

After continuing the plating process for 10 additional minutes, the parts were separated from the media, rinsed, and dried. They exhibited a bright zinc finish 0.0007" thick with very little part-to-part variability.

EXAMPLE 2

A small plastic plating barrel was charged with 2000 cc of glass impact media of which 70% was 5 mm in diameter, 25% was 10 to 13 mesh, 12½% was 16 to 25 mesh, and 30% was 50 mesh. To this barrel was charged 1361 grams of ¼"×2" hex head machine screws and a sufficient quantity of water to form a puddle approximately halfway across the barrel. To this barrel was added 5 ml of an inhibited acidic detergent sold under the trade number 0170 by McGean-Rohco. The barrel was rotated at 30 rpm for about 5 minutes, after which the parts were clean. To this solution was then added, without rinsing, 1 gram of Copper Sulfate Pentahydrate and 1 grams of Sodium Chloride. After 3 minutes the parts had a bright copper appearance. Then there was added to the barrel 0.5 grams of stannous oxide, 1 gram of sodium chloride, 0.3 grams of Carbowax 20M, and 0.1 gram of the Mannich reaction product of Rosin Amine D , Acetophenone, Formaldehyde and Acetone. After one minute there was added to the barrel 1 gram of zinc powder (grade MP-515 from Purity Zinc, Burlington, Ontario Canada) and after another two minutes the parts had the silvery appearance of tin. To the still-rotating barrel was then added in very small increments over a period of 15 minutes a slurry suspension consisting of:

- 15 ml water
- 8.40 grams of Zinc Dust Purity Zinc Grade MP-515)
- 3.6 grams of Tin Powder (TF-101 grade from Greenback Industries, Greenback, Tenn.)
- 0.04 grams Progacyl EM-30, a modified Guar Gum (Lyndal Chemical, Dalton, Ga.)
- 0.01 grams Carbowax 20M (Union Carbide, Danbury, Conn.)
- A trace of SWS-202 Defoamer (Wacker Silicones, Adrian, Mich.) and a trace of Pluronic F68 (BASF, Mt. Olive, N.J.)
- 0.01 grams Sodium Bicarbonate (Haviland Products, Grand Rapids, Mich.)

After continuing the plating process for 10 additional minutes, the parts were separated from the media, rinsed, and dried. They exhibited a bright finish of 70:30 zinc-tin 0.0004" in average thickness with very little part-to-part variability.

EXAMPLE 3

A small plastic plating barrel was charged with 2000 cc of glass impact media of which 50% was 5 mm in diameter, 25% was 10 to 13 mesh, 12½% was 16 to 25 mesh, and 12½% was 50 mesh. To this barrel was charged 1500 grams of standard ¼" washers and a sufficient quantity of water to form a puddle approximately halfway across the barrel. To this barrel was added 5 ml of an inhibited acidic detergent sold under the trade number 0170 by McGean-Rohco. The barrel was rotated at 30 rpm for about 5 minutes, after which the parts were clean. To this solution was then added, without rinsing, 1 gram of Copper Sulfate Pentahydrate and 1 gram of Sodium Chloride. After 3 minutes the parts had a bright copper appearance. The parts were rinsed several times and to the barrel was then added 1 gram of citric acid, 0.50 gram of diammonium citrate, 0.3 grams of Carbowax 20M, and 0.5 grams of stannous sulfate. After one minute there was added to the barrel 1 gram of zinc powder (grade MP-515 from Purity Zinc, Burlington, Ontario Canada) and after another two minutes the parts had the silvery appearance of tin. To the still-rotating barrel was then added a slurry suspension consisting of:

15 ml water 15 grams of Cadmium Dust (Federated Metals)

0.15 grams Polyox N-301 (Union Carbide, Danbury, Conn.)

0.06 grams Magnesium Hydroxide (Aldrich Chemicals, Milwaukee, Wisc.)

A trace of SWS-202 Defoamer (Wacker Silicones, Adrian, Mich.) and a trace of Siponic F707 (which is nonylphenol ethoxylated with 50 moles of ethylene oxide) (Rhone-Poulenc, Cranbury, N.J.) A trace of sodium hydroxide sufficient to raise the pH of the solution to 10.0

After continuing the plating process for 10 additional minutes, the parts were separated from the media, rinsed, and dried. They exhibited a bright cadmium finish with very little part-to-part variability. It should be noted that this example demonstrates a single compound acting as both the thickener and dispersant, and further, that this is a process that can reduce occupational exposure to toxic cadmium powder.

EXAMPLE 4

1000 pounds of hardened steel washers with a surface area of approximately 350 square feet were loaded to a 20 cubic foot (nominal capacity) mechanical plating barrel with approximately 20 cubic feet of glass beads, approximately 50% of which were 3 mm in diameter and the remainder were approximately 50 U.S. Mesh. The parts were cleaned conventionally with an inhibited solution of sulfuric acid, immersion coppered conventionally, and flashed with a thin deposit of tin conventionally, using stannous sulfate as the source of the tin and zinc dust as the reducing agent. Then there was added over a period of approximately 20 minutes 5 gallons of the following slurry composition:

| | |
|---|---|
| Zinc Dust (GRC-1 from Kraft Chemical, Chicago IL) | 25 pounds |
| Hydroxyethylcellulose (Natrosol 250HR from Aqualon, Wilmington, DE) | 71 grams |
| Magnesium Hydroxide (National Magnesia Chemicals, Moss Landing, CA) | 14 grams |
| Pluronic F68 (BASF, Mt. Olive, NJ) (a block copolymer of ethylene oxide and propylene oxide) | 1.4 grams |
| Attagel 50 (Engelhard Industries, Iselin, NJ) | 42 grams |
| Daxad 11 (Hampshire Chemical, Lexington, MA) (the sodium salt of a condensation polymer of naphthalene sulfonic acid and formaldehyde) | 14 grams |

After the addition of the metal slurry, the barrel was run approximately 10 minutes to conclude the deposition of the pulverulent metal, while maintaining the pH below 2 with sulfuric acid. The parts achieved an average thickness of 2.35 mils with a low of 2.05 mils and a high of 2.65 mils. The standard deviation was 0.182 mils and the coefficient of variation (also known as Pearson's Variability, the standard deviation divided by the mean) was 7.73%. (By comparison, a nearly identical load of the same parts mechanically galvanized by conventional metal addition, e.g., by adding 15 increments of metal, had a coefficient of variation of 27.8%).

It is appreciated that various modifications to the inventive concepts may be apparent to those skilled in the art without departing from the spirit and scope of the invention.

I claim:

1. In the process of mechanically coating a metal part with a surface metal wherein a plurality of parts are agitated within a receptacle containing a base liquid component, impact media, and a pulverulent surface metal, the improvement comprising:

(a) preparing a thickened pourable liquid aqueous slurry having a viscosity of about 2 centipoise to about 500 poise containing the pulverulent metal such that the pulverulent material is substantially uniformly suspended therein without continuous agitation, and (b) adding the slurry to the receptacle, wherein the base liquid component of said slurry is water.

2. The process of mechanically coating metal parts as in claim 1 wherein the impact media comprises glass beads.

3. The process of mechanically coating metal parts as in claim 1 wherein said slurry contains up to 15 pounds of pulverulent surface metal per gallon of water.

4. The process of mechanically coating metal parts as in claim 1 wherein the pH of the slurry is above 7 but not above about 11.

5. The process of mechanically coating metal parts as in claim 1 wherein the slurry contains from 0.01% to about 10% by volume of a dispersant.

6. The process of mechanically coating metal parts as in claim 1 wherein the slurry contains from about 1 ppm to about 100 ppm of an anti-foaming agent.

7. The process of mechanically coating metal parts as in claim 1 wherein the slurry contains from about 0.01% to about 10% by volume of a surfactant.

8. The process of mechanically coating a metal part with a pulverulent surface metal comprising agitating a plurality of parts within a container containing an impact media and a pulverulent metal, the pulverulent metal being added to the container in a thickened pourable liquid slurry containing the metal and a liquid carrier, the slurry comprising water and a thickener taken from the group of gum tragacanth, gum karaya, gum ghatti, gum arabic, xanthan gum and guar gum; modified natural products; synthetic water-soluble polymers; cellulose derivatives, and inorganic thickeners from the class of bentonite clay and attapulgite clays and their derivatives.

9. The process of mechanically coating metal parts as in claim 8, said slurry having a viscosity of from about 2 centipoise to about 500 poise.

10. The process of mechanically coating metal parts as in claim 9 wherein the impact media comprises glass beads.

11. The process of mechanically coating metal parts as in claim 9 wherein said slurry contains up to 15 pounds of pulverulent surface metal per gallon of water.

12. The process of mechanically coating metal parts as in claim 9 wherein the pH of the slurry is above 7 but not above about 11.

13. The process of mechanically coating metal parts as in claim 9 wherein the slurry contains from 0.01% to about 10% by volume of a dispersant.

14. The process of mechanically coating metal parts as in claim 9 wherein the slurry contains from about 1 ppm to about 100 ppm of an anti-foaming agent.

15. The process of mechanically coating metal parts as in claim 9 wherein the slurry contains from about 0.01% to about 10% by volume of a surfactant.

16. A slurry for adding pulverulent metal to a container for mechanically plating metal parts agitated in the container consisting of water, a pulverulent metal for coating the metal parts in concentration up to about 15 pounds per gallon of water and a thickener taken from the group of gum tragacanth, gum karaya, gum ghatti, gum arabic, xanthan gum and guar gum; modified natural products; synthetic water-soluble polymers; cellulose derivatives; and inorganic thickeners from the class of bentonite clay and attapulgite clays and their derivatives wherein the viscosity of the slurry will be from about 2 centipoise to about 500 poise.

17. In a slurry for mechanically plating metal parts as in claim 16, wherein the pH of the slurry is above 7 but not above about 11.

18. In a slurry for mechanically plating metal parts as in claim 16 wherein the slurry contains from 0.01% to about 10% by volume of a dispersant.

19. In a slurry for mechanically plating metal parts as in claim 16 wherein the slurry contains from about 1 ppm to about 100 ppm of an anti-foaming agent.

20. In a slurry for mechanically plating metal parts as in claim 16 wherein the slurry contains from about 0.01% to about 10% by volume of a surfactant.

* * * * *